US008206114B2

(12) United States Patent
Spangler et al.

(10) Patent No.: US 8,206,114 B2
(45) Date of Patent: Jun. 26, 2012

(54) GAS TURBINE ENGINE SYSTEMS INVOLVING TURBINE BLADE PLATFORMS WITH COOLING HOLES

(75) Inventors: Brandon W. Spangler, Vernon, CT (US); Corneil S. Paauwe, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 1327 days.

(21) Appl. No.: 12/111,240

(22) Filed: Apr. 29, 2008

(65) Prior Publication Data

US 2009/0269184 A1 Oct. 29, 2009

(51) Int. Cl.
*F01D 5/22* (2006.01)

(52) U.S. Cl. ..... 416/193 A

(58) Field of Classification Search ..... 416/193 A
See application file for complete search history.

(56) References Cited

U.S. PATENT DOCUMENTS

| | | | | |
|---|---|---|---|---|
| 4,712,979 | A | 12/1987 | Finger | |
| 5,281,097 | A | 1/1994 | Wilson et al. | |
| 5,344,283 | A | 9/1994 | Magowan et al. | |
| 5,382,135 | A * | 1/1995 | Green | 416/97 R |
| 5,413,458 | A | 5/1995 | Calberbank | |
| 6,017,189 | A | 1/2000 | Judet et al. | |
| 6,120,249 | A | 9/2000 | Hultgren et al. | |
| 6,190,130 | B1 * | 2/2001 | Fukue et al. | 416/97 R |
| 6,190,131 | B1 * | 2/2001 | Deallenbach | 416/193 A |
| 6,945,749 | B2 | 9/2005 | De Cardenas | |
| 7,186,089 | B2 | 3/2007 | Liang | |
| 7,255,536 | B2 | 8/2007 | Cunha et al. | |
| 2006/0093484 | A1 * | 5/2006 | Liang | 416/193 A |

* cited by examiner

*Primary Examiner* — Richard Edgar

(74) *Attorney, Agent, or Firm* — Carlson Gaskey & Olds, P.C.

(57) ABSTRACT

Gas turbine engine systems involving turbine blade platforms with mateface cooling holes are provided. In this regard, a representative turbine blade for a gas turbine engine includes: an airfoil having a leading edge, a trailing edge, a pressure side and a suction side; and a blade platform on which the airfoil is disposed, the blade platform having a pressure side mateface located adjacent to the pressure side of the airfoil and a suction side mateface located adjacent to the suction side of the airfoil, the blade platform having a cooling hole operative to direct a flow of cooling air toward an adjacent blade platform.

16 Claims, 3 Drawing Sheets

GAS TURBINE ENGINE SYSTEMS INVOLVING TURBINE BLADE PLATFORMS WITH COOLING HOLES

STATEMENT REGARDING FEDERALLY SPONSORED RESEARCH AND DEVELOPMENT

The U.S. Government may have an interest in the subject matter of this disclosure as provided for by the terms of contract number N00019-02-C-3003 awarded by the United States Navy.

BACKGROUND

1. Technical Field

The disclosure generally relates to gas turbine engines.

2. Description of the Related Art

Turbine blade platforms, from which blade airfoils extend, can experience platform distress due to lack of adequate cooling and low heat transfer. By way of example, turbine blade platforms can experience localized heavy distress, such as thermo-mechanical fatigue (TMF) cracks and oxidation. Such distress oftentimes occurs in regions where the airfoil trailing edges meet the pressure sides of the platforms. These regions are particularly difficult to cool without dramatically increasing the stress concentrations on the pressure sides of the platforms.

SUMMARY

Gas turbine engine systems involving turbine blade platforms with cooling holes are provided. In this regard, an exemplary embodiment of a turbine blade for a gas turbine engine includes: an airfoil having a leading edge, a trailing edge, a pressure side and a suction side; and a blade platform on which the airfoil is disposed, the blade platform having a pressure side mateface located adjacent to the pressure side of the airfoil and a suction side mateface located adjacent to the suction side of the airfoil, the blade platform having a cooling hole operative to direct a flow of cooling air toward an adjacent blade platform.

An exemplary embodiment of a turbine blade assembly for a gas turbine engine includes: a first turbine blade; and a second turbine blade operative to be positioned adjacent to the first turbine blade, the second turbine blade having a blade platform and an airfoil extending from the blade platform; the airfoil having a leading edge, a trailing edge, a pressure side and a suction side; the blade platform having a first side facing away from the first turbine blade and a second opposing side facing toward the first turbine blade, the blade platform being operative to direct a flow of cooling air therethrough such that the cooling air impinges upon a portion of the first turbine blade.

An exemplary embodiment of a gas turbine engine includes: a compressor; and a turbine operative to drive the compressor, the turbine having a turbine blade assembly, the turbine blade assembly having a first turbine blade and a second turbine blade; the second blade being positioned adjacent to the first turbine blade, the second turbine blade having a blade platform and an airfoil extending from the blade platform; the first blade being operative to direct a flow of cooling air such that the cooling air impinges upon the blade platform of the second turbine blade.

Other systems, methods, features and/or advantages of this disclosure will be or may become apparent to one with skill in the art upon examination of the following drawings and detailed description. It is intended that all such additional systems, methods, features and/or advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale. Moreover, in the drawings, like reference numerals designate corresponding parts throughout the several views.

DETAILED DESCRIPTION

Gas turbine engine systems involving turbine blade platforms with cooling holes are provided, several exemplary embodiments of which will be described in detail. In various embodiments, pressure sides of turbine blade platforms are cooled to reduce distress, such as thermo-mechanical fatigue (TMF) cracks and oxidation. Cooling of a pressure side of a blade platform is accomplished in some embodiments by providing cooling holes through the suction side mateface of an adjacent blade platform. This enables cooling air to be provided to the pressure side of one blade platform from an adjacent blade platform. Notably, the region of the pressure side platform where the platform joins an associated airfoil is particularly difficult to cool without increasing the stress concentration on the pressure side platform.

Figure 1:
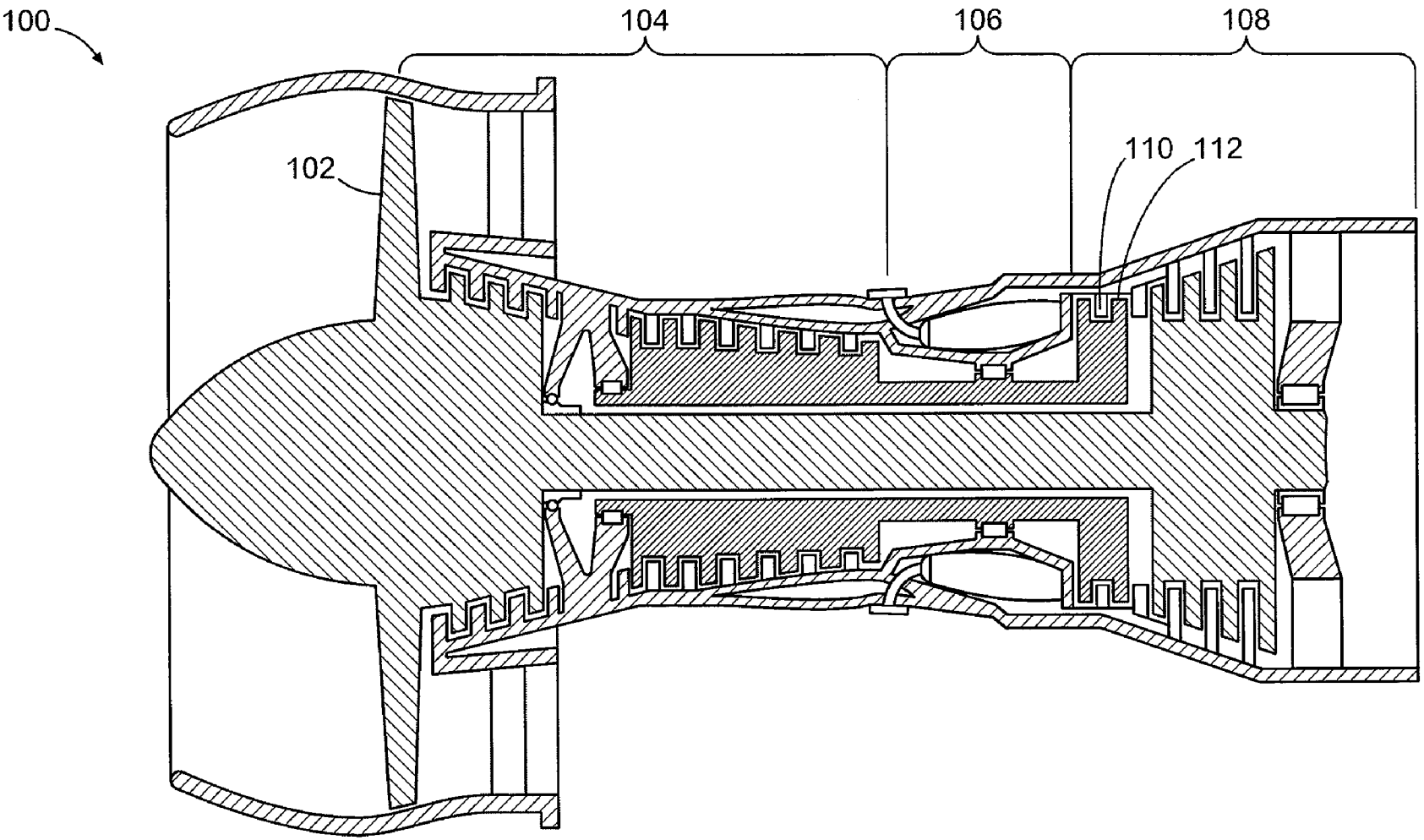
FIG. 1 is a schematic diagram depicting an exemplary embodiment of a gas turbine engine.

In this regard, FIG. 1 is a schematic diagram depicting an exemplary embodiment of a gas turbine engine 100. As shown in FIG. 1, engine 100 is depicted as a turbofan that incorporates a fan 102, a compressor section 104, a combustion section 106 and a turbine section 108. Turbine section 108 includes alternating sets of stationary vanes (e.g., vane 110) and rotating blades (e.g., blade 112). Although depicted as a turbofan gas turbine engine, it should be understood that the concepts described herein are not limited to use with turbofans as the teachings may be applied to other types of gas turbine engines.

Figure 2:
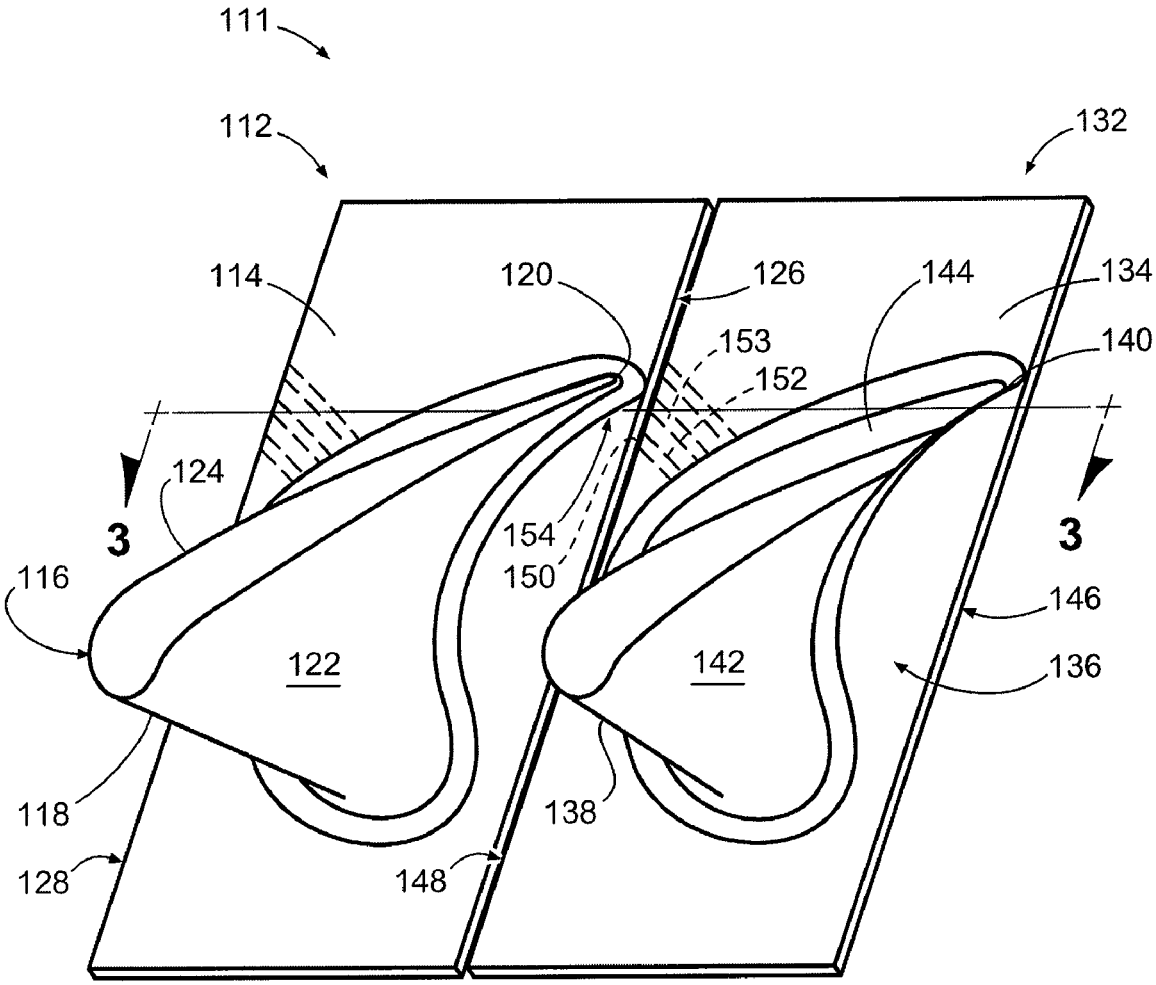
FIG. 2 is a top, perspective diagram depicting a representative turbine blade platform assembly from the embodiment of FIG. 1.

FIG. 2 is a top, perspective diagram depicting a representative turbine blade platform assembly 111 of the embodiment of FIG. 1. In particular, FIG. 2 depicts blade 112 and an adjacent blade 132. As shown in FIG. 2, blade 112 includes an inner diameter platform 114 that supports an airfoil 116. The airfoil includes a leading edge 118, a trailing edge 120, a pressure side 122 and a suction side 124. As such, the platform 114 includes a pressure side mateface 126 and a suction side mateface 128. Similarly, blade 132 includes an inner diameter platform 134 that supports an airfoil 136. The airfoil includes a leading edge 138, a trailing edge 140, a pressure side 142 and a suction side 144. As such, the platform 134 includes a pressure side mateface 146 and a suction side mateface 148.

Additionally, each of the platforms includes cooling holes that provide cooling air for cooling a portion of a corresponding adjacent blade. By way of example, blade 132 incorporates cooling holes (e.g., cooling hole exit 150 located at the end of cooling hole 152) for directing cooling air to blade 112. In this embodiment, region 154 to which the cooling air is directed includes that portion of blade 112 oriented at the pressure side mateface 126 of platform 114 near the trailing edge of the airfoil 116. The cooling holes that provide cooling air to the cooling hole exits are generally oriented parallel to each other (e.g., holes 152, 153 are parallel).

Figure 3:
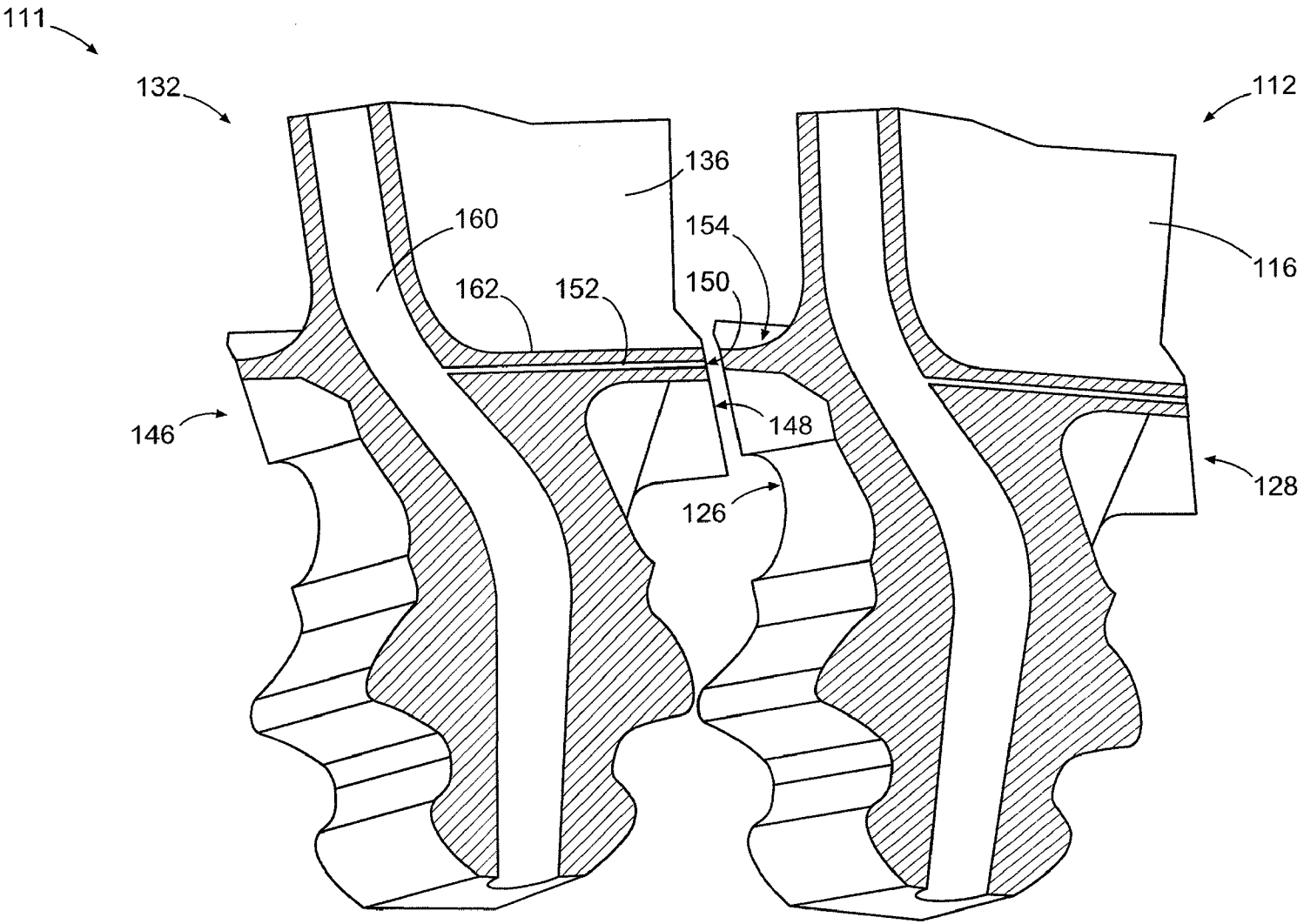
FIG. 3 is a cross-sectional diagram of the turbine blade platform assembly depicted in FIG. 2, as viewed along section line 3-3.

As shown in the cross-sectional view of FIG. 3, the cooling holes pneumatically communicate with interior cooling passage of the blades. For instance, cooling hole exit 150 communicates with cooling passage 160 via cooling hole 152. As such, cooling air provided to the cooling passage is metered to the cooling hole for cooling region 154 of adjacent blade 122. Notably, in this embodiment, the cooling holes are oriented parallel to the corresponding outer diameter surfaces of the blade platforms through which the cooling holes extend. By way of example, cooling hole 152 is parallel to outer diameter surface 162. Various other numbers and orientations of cooling holes can be used in other embodiments.

It should also be noted that in the embodiment of FIGS. 1-3, the cooling holes extend through the suction side matefaces of the blade platforms for directing cooling air toward corresponding pressure side matefaces of adjacent blade platforms. Routing the cooling air through holes formed in the suction side matefaces, where platform stress tends to be lower than that of a pressure side mateface, stress concentrations of the turbine blade platform assembly may be reduced.

Although the embodiment of FIGS. 1-3 incorporates multiple cooling holes, each of which communicates with a separate cooling passage, in other embodiments, multiple cooling holes can communicate with a single cooling passages. Thus, such a cooling passage provides cooling air to more than one cooling hole.

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. All such modifications and variations are intended to be included herein within the scope of this disclosure and protected by the accompanying claims.

The invention claimed is:

1. A turbine blade for a gas turbine engine comprising:

an airfoil having a leading edge, a trailing edge, a pressure side and a suction side, an interior cooling passage extends at least partially into the airfoil; and a blade platform on which the airfoil is disposed, the blade platform having a pressure side mateface located adjacent to the pressure side of the airfoil and a suction side mateface located adjacent to the suction side of the airfoil, the blade platform having a cooling hole that pneumatically communicates with the interior cooling passage, the cooling hole having a cooling hole exit in the suction side mateface to direct a flow of cooling air through the suction side mateface toward a trailing edge of an airfoil disposed on an adjacent blade platform, the cooling hole raked aftward.

2. The turbine blade of claim 1, wherein:

the cooling hole is operative to direct the flow of cooling air toward the pressure side mateface of the adjacent blade platform such that the cooling flow impinges upon the pressure side mateface.

3. The turbine blade of claim 1, wherein the cooling hole exit is a first of multiple cooling hole exits located in the suction side mateface of the blade platform.

4. The turbine blade of claim 3, wherein each cooling hole exit has a corresponding cooling hole in communication with the interior cooling passage.

5. The turbine blade of claim 4, wherein each cooling hole is oriented parallel to an adjacent cooling hole.

6. The turbine blade of claim 1, wherein the cooling hole is oriented parallel to an outer diameter surface of the blade platform.

7. The turbine blade of claim 1, wherein the blade platform is an inner diameter platform.

8. The turbine blade of claim 1, wherein the cooling hole is oriented along the blade platform.

9. The turbine blade of claim 1, wherein the cooling hole is oriented parallel to a blade platform outer surface.

10. A turbine blade assembly for a gas turbine engine comprising:

a first turbine blade having a first blade platform and a first airfoil extending from the first blade platform; and positioned adjacent to the first turbine blade, the second turbine blade having a second blade platform and a second airfoil extending from the second blade platform;

the second airfoil having a leading edge, a trailing edge, a pressure side and a suction side, an interior cooling passage extends at least partially into the second airfoil;

second blade platform having a first side facing away from the first turbine blade and a second opposing side facing toward the first turbine blade, the second blade platform having a mateface with a cooling hole that pneumatically communicates with the interior cooling passage, the cooling hole raked aftward to a cooling hole exit in the mateface operative to direct a flow of cooling air through the mateface toward a trailing edge of the first airfoil of the first turbine blade.

11. The assembly of claim 10, wherein: the first side is a pressure side of the platform; and the second side is a suction side of the platform.

12. The assembly of claim 10, wherein the blade platform of the second turbine blade is operative to direct the flow of cooling air such that the cooling air impinges upon a pressure side mateface of the blade platform of the first turbine blade.

13. A gas turbine engine comprising:

a compressor; and a turbine operative to drive the compressor, the turbine having a turbine blade assembly, the turbine blade assembly having a first turbine blade and a second turbine blade; the second blade being positioned adjacent to the first turbine blade, the second turbine blade having a blade platform and an airfoil extending from the blade platform;

the first blade being operative to aftwardly direct a flow of cooling air through a suction side mateface trailing edge of an airfoil disposed on an adjacent blade platform such that the cooling air impinges upon a pressure side mateface toward a trailing edge of the second turbine blade.

14. The engine of claim 13, wherein: the cooling flow impinges upon the pressure side mateface in a vicinity of a trailing edge of the airfoil of the second blade.

15. The engine of claim 13, wherein the turbine is a high pressure turbine.

16. The engine of claim 13, wherein the engine is a turbofan gas turbine engine.

* * * * *